United States Patent [19]

Brock et al.

[11] 3,991,482

[45] Nov. 16, 1976

[54] SUPERHEAT APPARATUS FOR DRYING TEXTILE PRODUCTS

[75] Inventors: James Donald Brock; Erbie Gail Mize, both of Chattanooga, Tenn.

[73] Assignee: Astec Industries, Inc., Chattanooga, Tenn.

[22] Filed: Feb. 24, 1976

[21] Appl. No.: 660,809

Related U.S. Application Data

[62] Division of Ser. No. 499,577, Aug. 22, 1974, Pat. No. 3,955,287.

[52] U.S. Cl. ..... 34/48; 34/155; 34/212; 34/216; 432/144; 432/152

[51] Int. Cl.[2] ..... F26B 19/00

[58] Field of Search ..... 34/23, 28, 31, 48, 115, 34/155, 158, 162, 210–212, 215–217; 432/59, 144, 145, 152

[56] References Cited

UNITED STATES PATENTS

| | | | |
|---|---|---|---|
| 2,107,275 | 2/1938 | Anderson et al. | 34/48 |
| 2,750,272 | 6/1956 | Lellep | 432/8 |
| 3,295,842 | 1/1967 | Stelling, Jr. et al. | 34/48 |
| 3,745,670 | 7/1973 | Hartwig | 34/217 |
| 3,806,310 | 4/1974 | Brock | 34/216 |
| 3,849,904 | 11/1974 | Willalobos | 34/216 |

*Primary Examiner*—John J. Camby
*Assistant Examiner*—Larry I. Schwartz

[57] ABSTRACT

Apparatus and method for removing moisture from textile products which are sufficiently porous to permit a substantial flow of heated fluid through the product. Two separate drying regions are provided through which a web of textile product is serially moved. The textile product divides each drying region into a pair of drying zones, and a differential pressure of heated air is maintained on opposite sides of the textile product in each of the heating regions to maintain a flow of heated air through the textile product. The wet textile product first passes through an initial heating region for flowthrough exposure to air heated to a temperature exceeding the temperature at which the dry textile product is damaged, for evaporation of unbound moisture without damaging the textile product. The textile product then passes through a subsequent heating region for flow-through exposure to recirculating air at a temperature which is nondamaging to the textile product. Heated air is withdrawn from the air being recirculated in the second region, further heated, and supplied to the initial or superheat region for more efficient operation.

2 Claims, 12 Drawing Figures

SUPERHEAT APPARATUS FOR DRYING TEXTILE PRODUCTS

This is a division of application Ser. No. 499,577, filed Aug. 22, 1974, now U.S. Pat. No. 3,955,287.

This invention relates in general to evaporative drying, and in particular to apparatus and methods for drying various types of textile products having sufficient porosity to maintain an effective flow of air or other heated fluid through the product when a pressure differential is maintained across the product. Typical examples of such porous textile products are woven textile products in general, including tufted carpet products having woven backing material.

One of the final steps involved in the process of finishing carpet and other textile products is washing the carpet, at which time the carpet becomes substantially impregnated with water and must be subsequently dried before being wound onto rolls or otherwise processed for subsequent utilization. Carpet and other textile products are generally manufactured in continuous webs of various predetermined widths, and the drying process in the prior art has been provided by drying ovens through which the carpet is slowly moved while being exposed to heated air. Such prior-art drying ovens are quite long, and the carpet may be required to make multiple passes back and forth through the oven before finally emerging in a completely-dry state. It will be appreciated by those skilled in the art that such prior-art drying ovens frequently exceed 100 feet in length. Since the maximum heating temperature in such ovens has been limited by the ignition temperature of the carpet or other textile product being dried, it will be understood that the great length of drying "pass" distance within the oven is required to provide carpet drying speeds that are sufficiently high for compatibility with the operating speeds of other equipment used in the carpet finishing process.

Various types of textile drying apparatus have been proposed which provide multiple drying stages for a moving carpet or other textile product, so that the moisture-saturated carpet first entering the dryer can be subjected to heated fluid having different temperatures or humidity characteristics, for example, than the heated fluid applied to the partially-dry carpet at one or more subsequent heating regions. Examples of such prior-art dryers are disclosed in U.S. Pat. Nos. 3,362,087; 3,641,681; and 3,743,487. While such prior-art dryers repesented some improvement in the art, the need still exists for a textile drying apparatus having further improved operating speed without a corresponding increase in the overall length and/or the fuel consumption of the dryer.

Accordingly, it is an object of the present invention to provide improved method and apparatus for drying textile products.

It is another object of the present invention to provide an improved flow-through method and apparatus for drying carpet and other textile products.

It is yet another object of the present invention to provide a web-feed textile drying method and apparatus which is capable of operating at web speeds greater than possible with present drying equipment.

The foregoing and other objects and advantages of the present invention will become more readily apparent from the following description of a disclosed embodiment, as shown in the drawing, wherein.

The term "unbound moisture" is used herein to denote an amount of moisture carried by a wet textile product at least sufficient so that substantially all of the heat energy transferred to the textile product in a heated environment is used in evaporating the moisture, leaving substantially no heat remaining to increase the temperature of the textile product. The textile product is said to contain "bound moisture" when the amount of moisture is insufficient for evaporation to prevent temperature rise of the textile product. A "critical amount" of moisture carried by the textile product is that amount of moisture which is just sufficient to evaporate all heat received by the textile product, and represents the boundary between unbound and bound moisture.

Stated in general terms, a wet textile product is dried according to the present invention by evaporating at least a portion of the unbound moisture while subjecting the textile product to heated fluid at a temperature exceeding the temperature which would cause damage to the dry textile product, and by thereafter evaporating the moisture remaining in the textile product while subjecting the textile product to heated fluid at a temperature less than the damage temperature of the product. The foregoing is accomplished by serially passing the textile product through an initial heating region, referred to hereinafter as the "superheat region," wherein the textile product is exposed to a fluid medium heated to a temperature exceeding the damage temperature of the product. The textile product remains in the superheat region while not more than the unbound moisture is evaporated, after which the textile product enters a second or "main heat region" where the moisture remaining in the textile product is evaporated by exposure to heated fluid at a temperature less than the ignition point of the product. Stated more specifically, each of the two heating regions of a drying apparatus according to the present invention is divided into two separate zones by the textile products, and a differential pressure is maintained across the two zones of each heating region to establish flow of heated fluid through the porous textile product. Heated fluid in the main heat region is recirculated by flowing through the porous textile product, and a portion of the fluid in the main heat region is supplied to the superheat region to receive additional heating for flow-through superheat drying of the textile product therein. Make-up air is supplied only to the main heating region, and moisture-laden air is withdrawn only from the superheat region of the drying apparatus. Safeguards are provided to prevent the textile product from becoming overheated in the superheat region.

Figure 1:
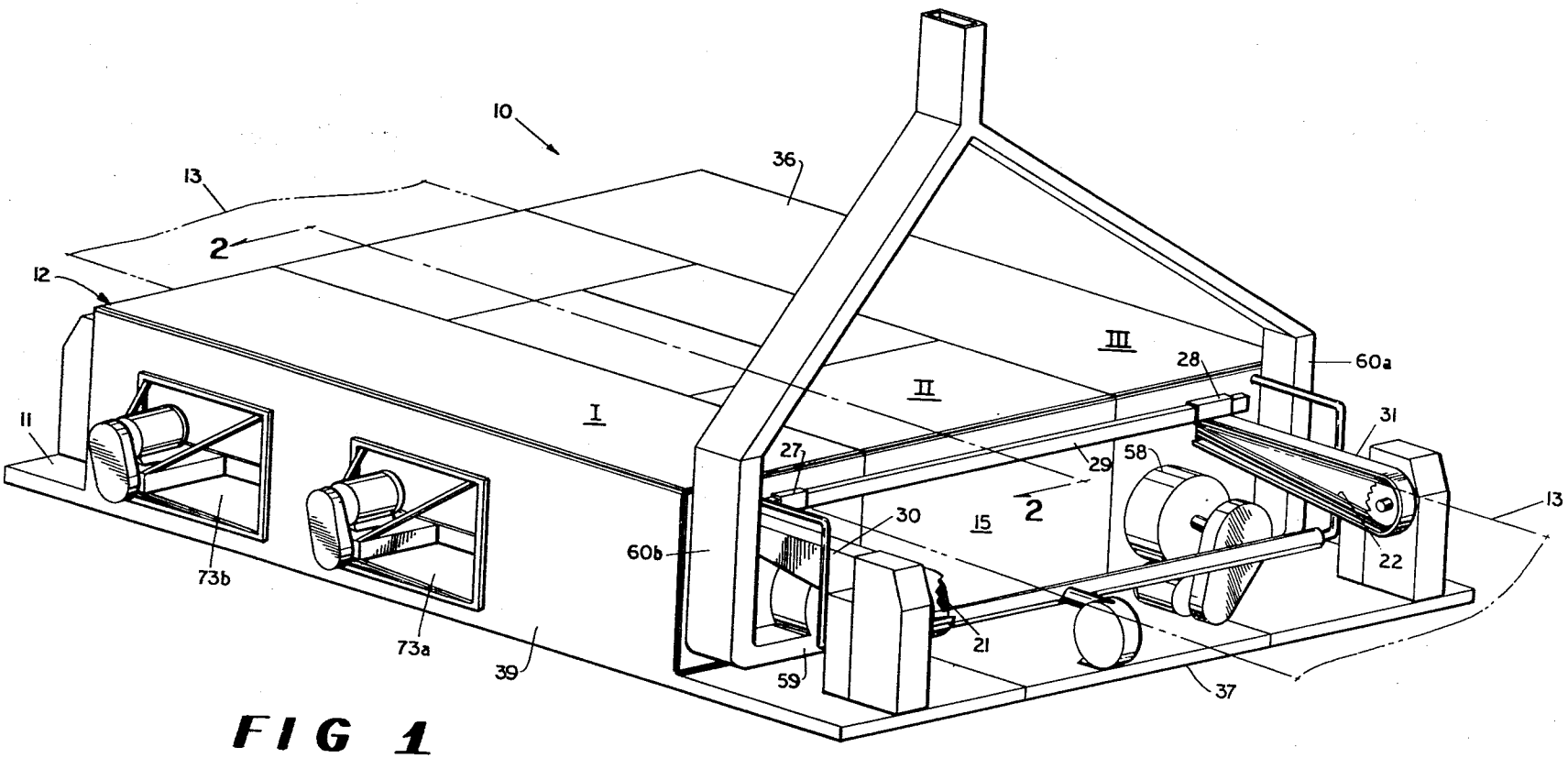
FIG. 1 shows a pictorial view of the disclosed embodiment of the present invention.
Figure 8:
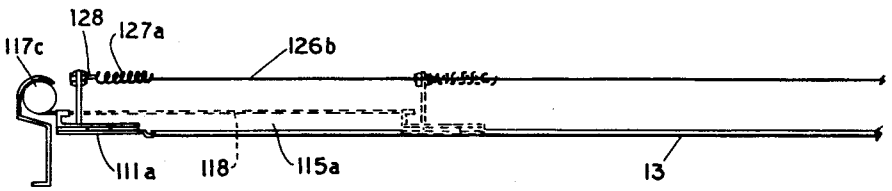
FIG. 8 is a fragmentary elevation view showing two possible positions of the tenter seal assembly.
Figure 7:
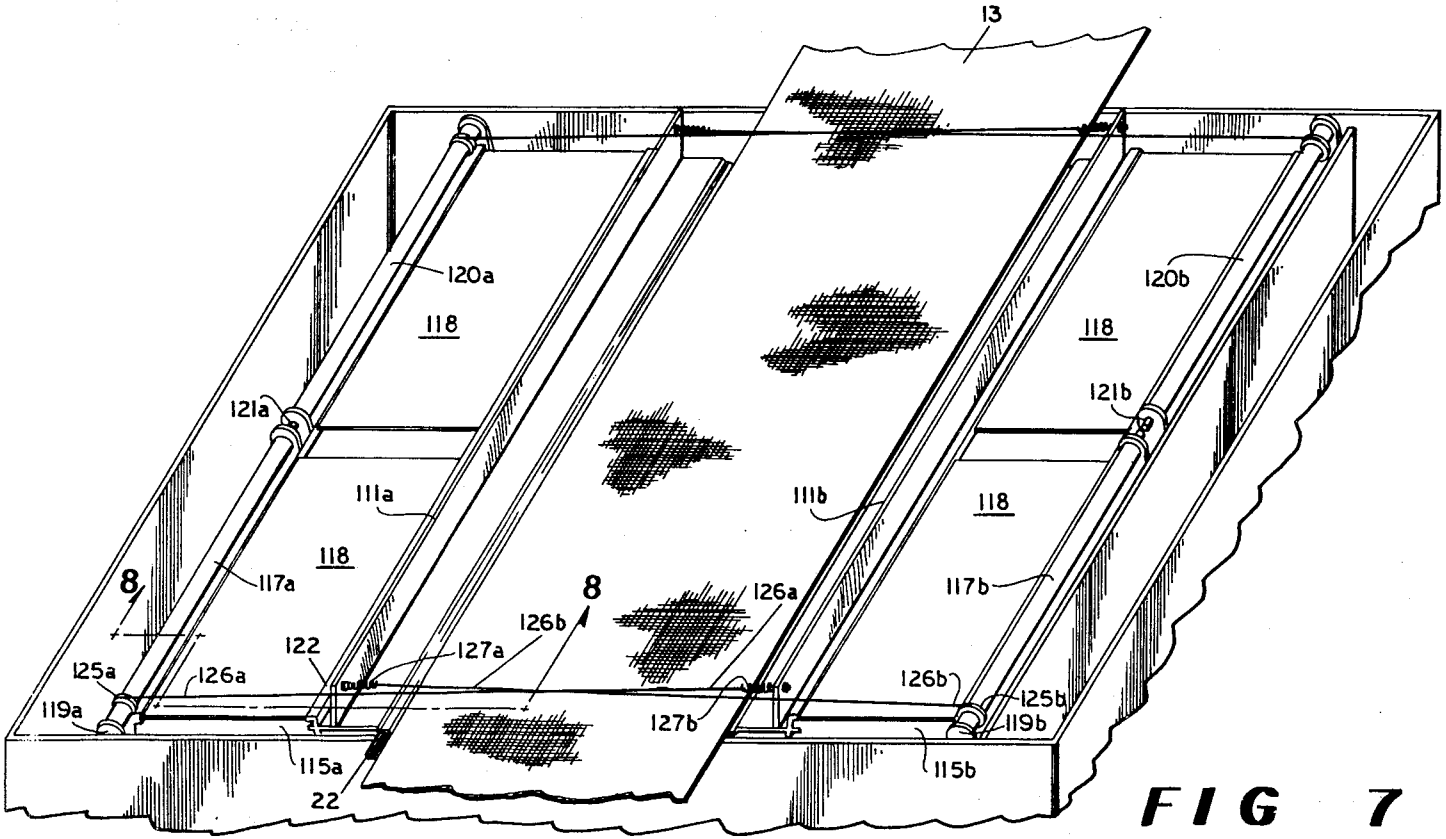
FIG. 7 is a fragmentary pictorial view showing details of the tenter seal assembly in the disclosed embodiment.
Figure 9:
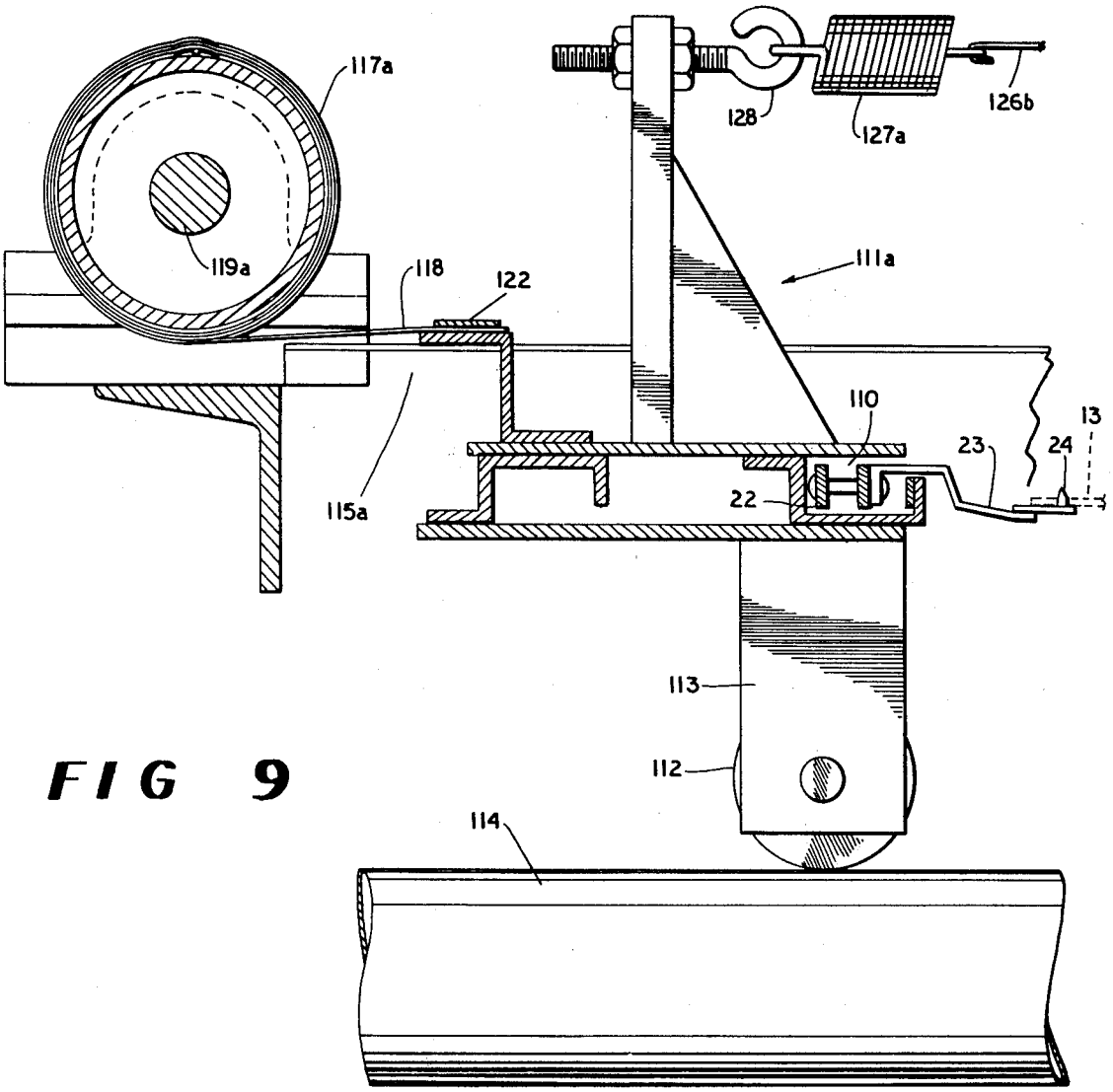
FIG. 9 is an elevation view showing details of the tenter seal assembly and support structure.

The present invention is better understood with reference to the specific embodiment described herein and shown generally at 10 in FIG. 1. The dryer apparatus is mounted on a base 11 and includes an oven assembly 12 within which the superheat and main drying regions are contained as described hereinbelow. The oven assembly 12 may advantageously be fabricated in three longitudinally-divided sections I, II, and III to facilitate shipment of the oven to a user location whereat the sections can be assembled. A web of textile product such as a carpet 13, in the disclosed embodiment of the invention, is shown entering the oven assembly 12 through a slotted opening 14 formed in the front end 15 of the oven apparatus, and it will be understood that a corresponding slotted opening 18 is formed in the back end 16 of the oven assembly for exit movement of the carpet. The carpet is supported for movement through the dryer by a tenter frame assembly including a pair of endless tenter chains 21 and 22 which are moved through chain passages in respective chain support members 111b and 111a, as shown in FIGS. 7–9 and described in greater detail below. The chain support members are mounted for selective lateral movement by mechanisms including the laterally-movable support members 27 and 28, which are laterally movable toward or away from one another along the track 29. A suitable and known traversing means such as a reverse-threaded screw or the like can be incorporated with the track 29 to accomplish lateral movement of the support members 27 and 28, and the associated chain support members.

The tenter chains 21 and 22 extend forwardly a distance in front of the front end 15 of the oven to receive and support the web of carpet 13 supplied from a washer or another prior stage in a carpet finishing operation. Suitable chain guards 30 and 31 are preferably provided to surround the extended portions of the tenter chains.

Figure 2:
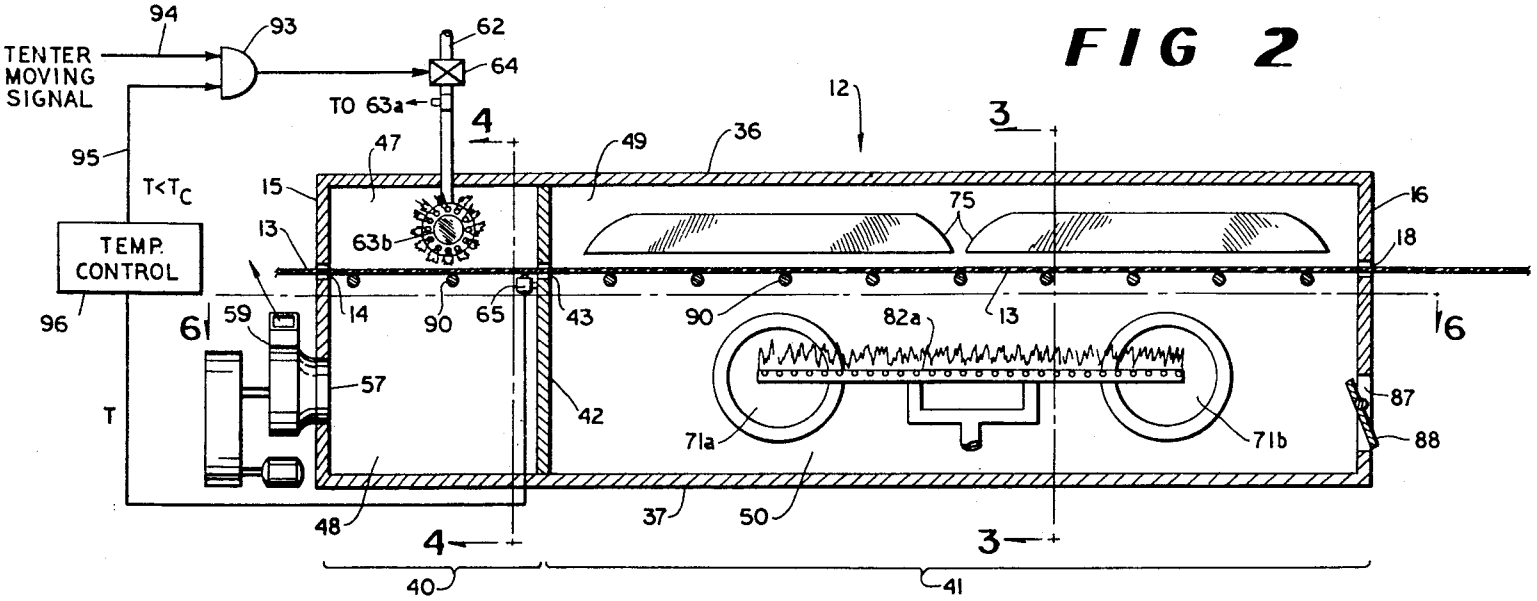
FIG. 2 shows a longitudinal elevation section view taken along line 2—2 of FIG. 1.

It is particularly apparent from FIGS. 2–5 that the oven assembly 12 is defined by a top wall 36, a bottom wall 37, and the two sidewalls 38 and 39, along with the aforementioned front end 15 and back end 16. Each of these walls and ends is preferably insulated to minimize heat transfer therethrough, thereby increasing the operational efficiency of the dryer assembly. With particular reference to FIG. 2, it can be seen that the interior region of the oven assembly 12 is divided into a first region 40, referred to herein as the "superheat region," and a main heating region 41, by means of a wall 42 which extends vertically between the bottom wall 37 and the top wall 46. A laterally-elongated aperture 43 is provided in the wall 42 to permit substantially unobstructed passage of the carpet 13 from the superheat region 40 to the main heating region 41. The thickness or vertical dimension of the aperture 43, as viewed in FIG. 2, is chosen with regard to the particular textile product being dried so as to minimize airflow through the aperture 43 between the superheat region 40 and the main heating region 41, to the maximum extent practicable, although in practice any differential pressure existing between the two heating regions may cause a negligible volume of airflow through the aperture 43. Each of the two heating regions 40 and 41 is further divided into two separate zones by the presence of a web of carpet 13 or other textile product extending through the oven assembly for drying therein, and such zones are hereinafter identified as a first zone 47, a second zone 48, a third zone 49, and a fourth zone 50.

Figure 5:
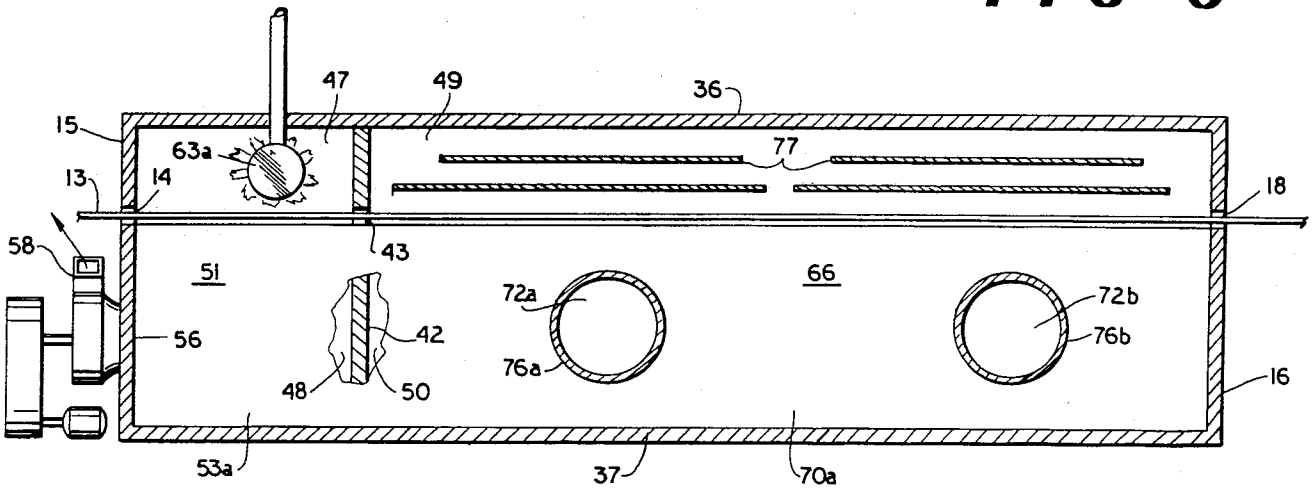
FIG. 5 is a longitudinal elevation section view taken along line 5—5 of FIG. 3.
Figure 4:
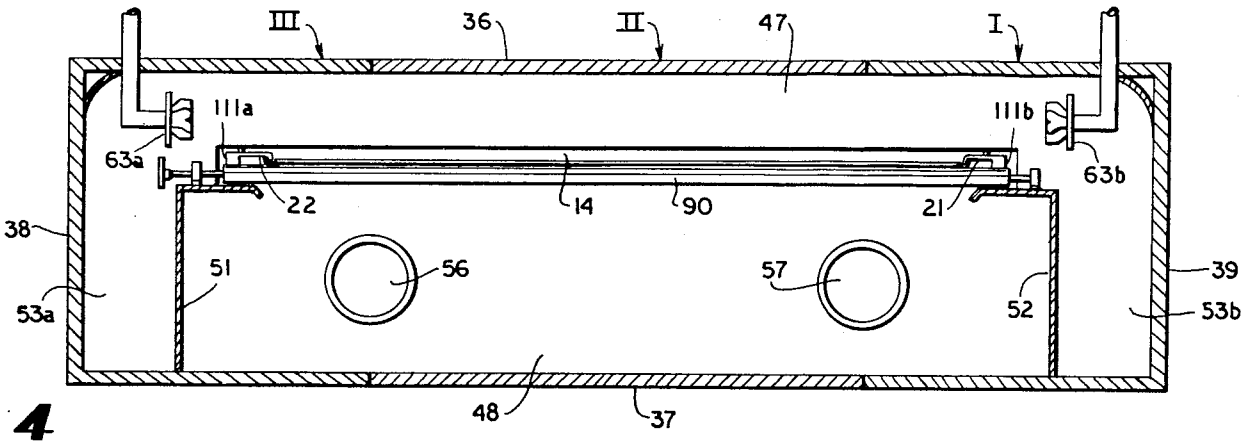
FIG. 4 shows a lateral elevation section view taken along line 4—4 of FIG. 2.
Figure 6:
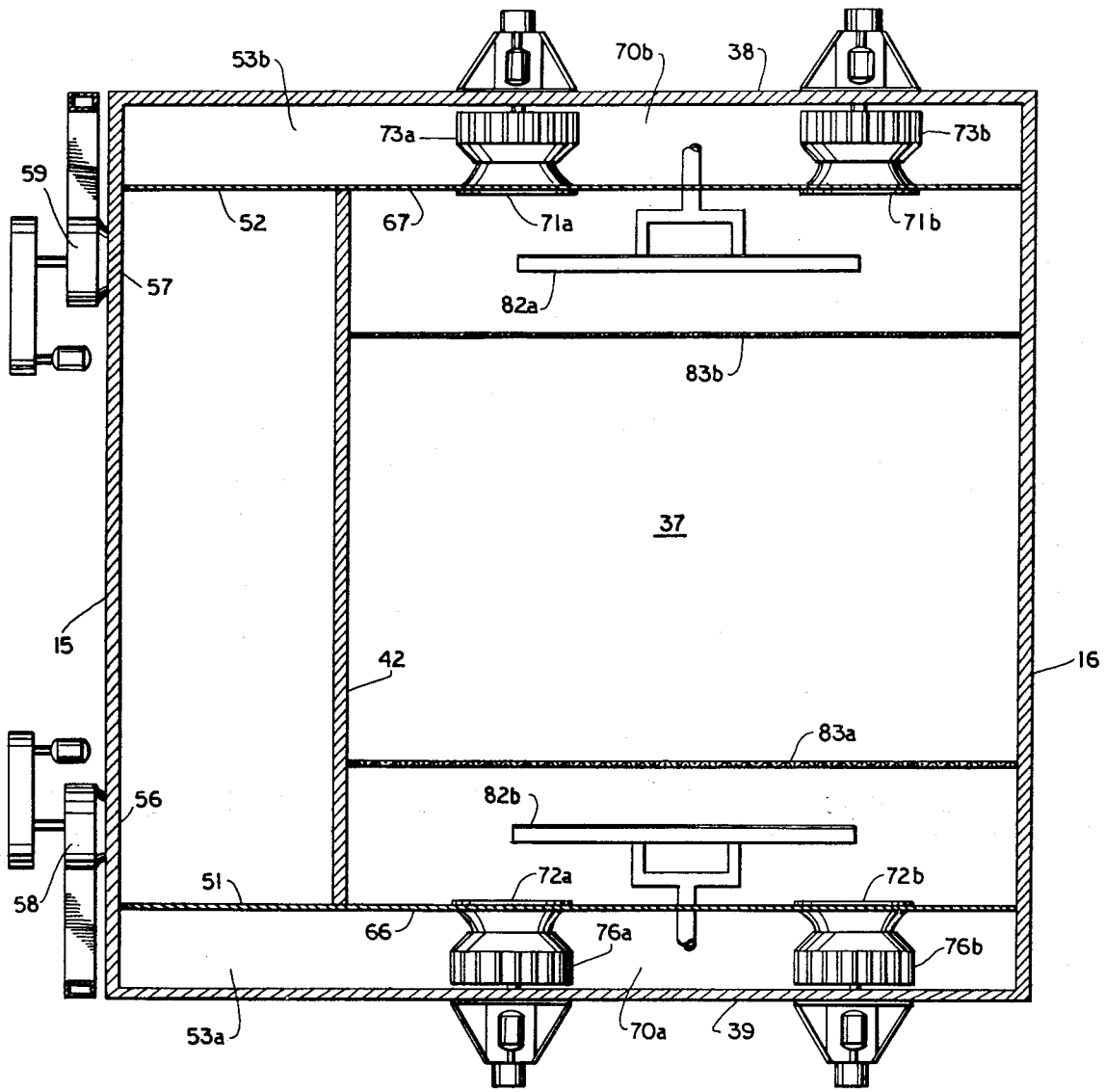
FIG. 6 is a plan section view taken along line 6—6 of FIG. 2.

Referring particularly to FIGS. 4 and 5, it is seen that the second zone 48 of the superheat region 40 is further defined by a pair of partition plates 51 and 52 which extend vertically upwardly from the bottom wall 37 to a position somewhat below the vertical elevation position of the chain support members 111a and 111b of the tenter frame assembly. The second zone 48 is thus defined by the bottom wall 37 of the oven, the two partition plates 51 and 52, the dividing wall 42, and the front end 15 of the oven assembly. The two partition plates 51 and 52 are spaced laterally inwardly from the corresponding sidewalls 38 and 39 of the oven assembly, so that a pair of plenums **53*a* and 53*b* are provided between the corresponding spaced-apart partition plates and sidewalls. The purpose of these plenums is set forth below. A pair of exhaust outlets 56 and 57 is formed in the front end 15 of the oven assembly, in communication with the second zone 48 on the lower side of the superheat region 40, as best seen in FIGS. 2 and 6. A pair of exhaust fans 58 ad 59 are respectively connected to each of the two outlets 56 and 57, and operate to remove air or other fluid from the second region 48 and discharge such removed fluid through the discharge ducts 60a and 60b** to a location removed from the dryer apparatus.

The first zone 47 of the superheat region 40, as best seen in FIGS. 2 and 4, includes heating apparatus such as the pair of gas burners **63*a* and 63*b*, both of which are connected to a fuel-air mixture supply line 62 through suitable plumbing including a burner valve 64. It will be appreciated that the burner valve 64 controls the flow of gas to the burners 63*a* and 63*b*, and that each of such burners may be equipped with a pilot light (not shown) supplied with fuel-air mixture from a line independent of the burners 63*a* and 63*b*, so that the pilot lights remain lit irrespective of the burner valve 64, whereby the burners 63a and 63b are automatically ignited when the burner valve 64 is turned on. The control and operation of the burner valve 64** is discussed below.

Figure 3:
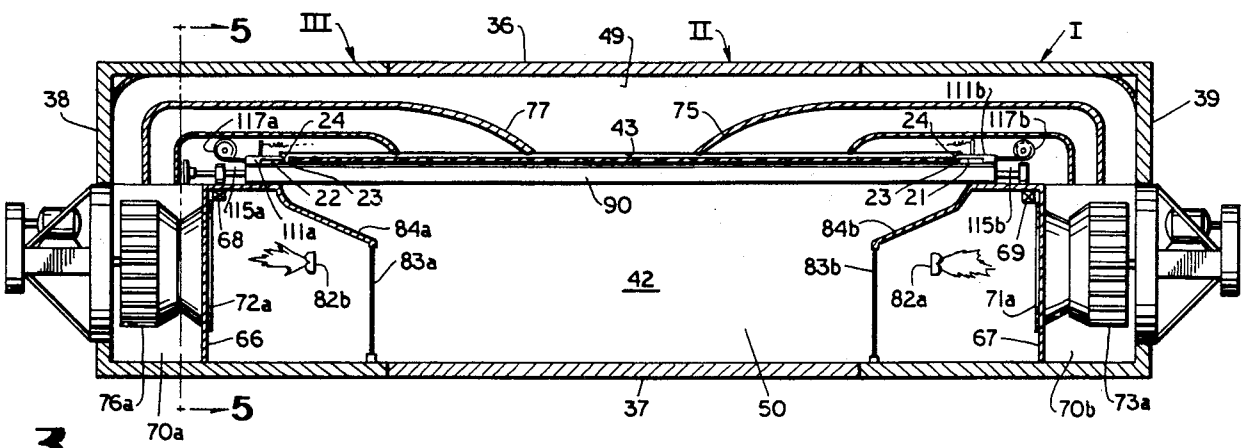
FIG. 3 shows a lateral elevation section view taken along line 3—3 of FIG. 2.

Details of the main heating region 41 are best seen in FIGS. 2, 3, and 6. A pair of partition plates 66 and 67, vertically extending from the bottom wall 37 upwardly to a pair of longitudinal support members 68 and 69, extend longitudinally of the main heating region 53 in spaced apart relation to the sidewalls 38 and 39, defining corresponding plenums 70a and 70b between the partition plates and the sidewalls. The partition plates 66 and 67 may comprise extensions of the partition plates 51 and 52 associated with the superheat region 40. A pair of fan openings **71*a* and 71*b* are formed in the partition plate 67 in communication with the fourth zone 50 below the carpet 13, as shown in FIGS. 2 and 6, and a pair of fans 73*a* and 73*b* are positioned to withdraw air or other fluid from the fourth zone 50 through the fan openings 71*a* and 71*b*. The air withdrawn from the fourth zone 50 by each of the fans 73*a*and 73*b* is discharged into the plenum 70*b*, and is allowed to flow from the plenum upwardly through flow passages defined by the air flow structure 75 to enter the third zone 49, above the carpet 13 passing through the main heating region 41. Another pair of fans 76***a* and 76*b* is disposed to withdraw air from the fourth region 50 and through the openings 72*a* and 72*b* into the plenum 70*a*, wherefrom the air is returned to the third zone 49 by way of the air flow structure 77.

The air or other fluid in the main heating region 41 is heated by any suitable source of heat such as the gas burners 82*a* and 82*b*, each of which may be premix-type burners of conventional design and all of which are connected through appropriate operating controls to a suitable fuel-air supply. The main gas burners 82*a* and 82*b* are preferably supplied with fuel-air mixture independently of the burner valve 64 associated with the superheat burners 63*a* and 63*b* in the superheat region 40, so that the operation of the superheat burners 63*a* and 63*b* can be controlled independently of the main burners 82*a* and 82*b*. Each of the main burners 82*a* and 82*b* is preferably positioned adjacent the air inlets of a corresponding pair of the four main heating region fans 73*a*, 73*b* and 76*a*, 76*b*, so that the main burners supply heat to the fluid being recirculated for return to the third region 49.

Figure 11:
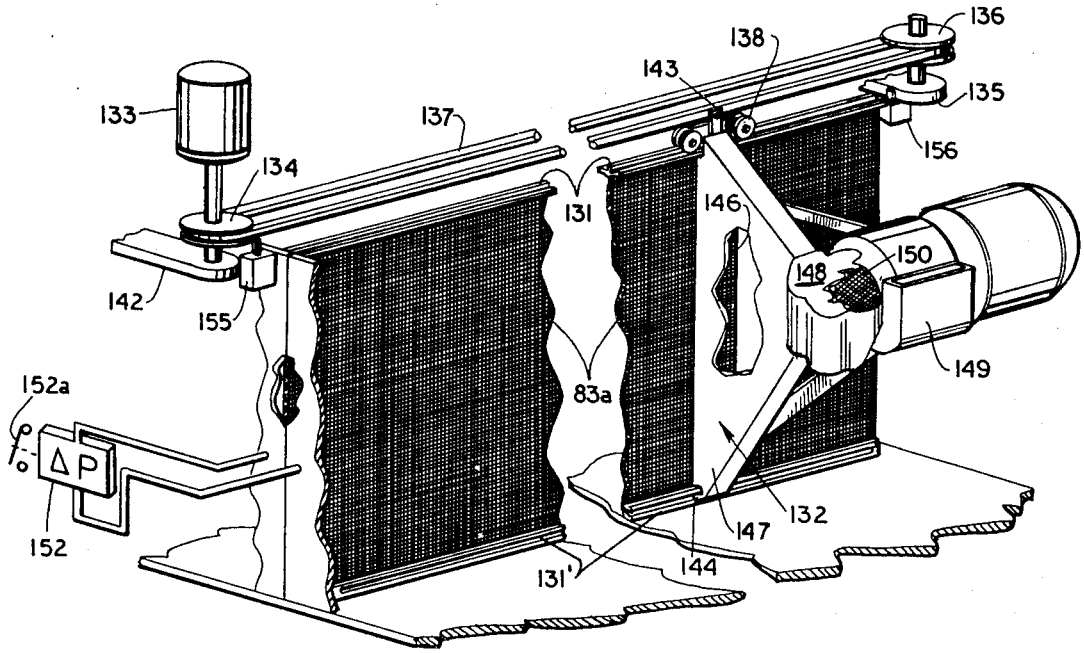
FIG. 11 is a pictorial view of lint screen cleaning apparatus according to a disclosed embodiment of the present invention.
Figure 12:
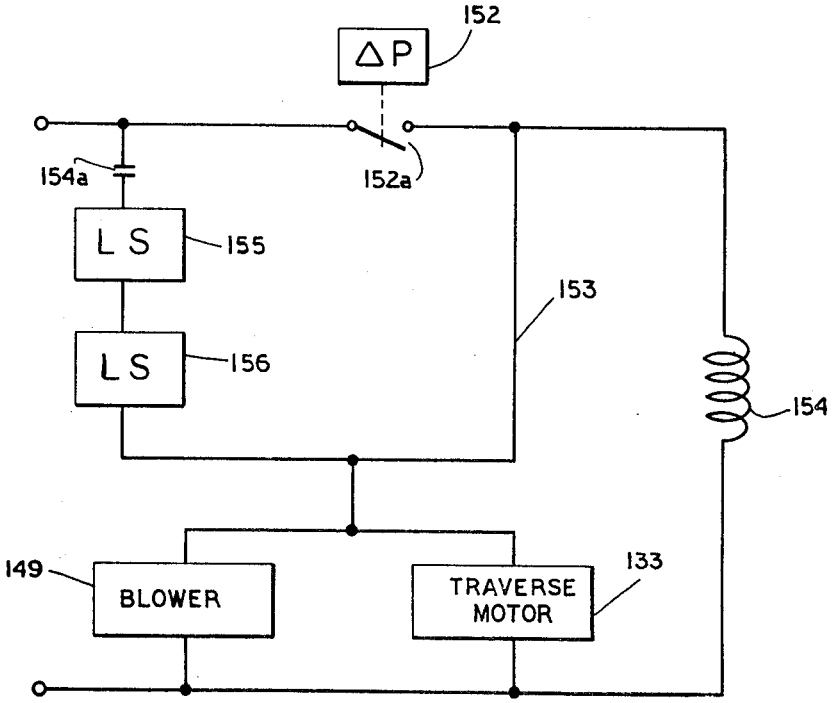
FIG. 12 is a schematic view of a control circuit associated with the screen cleaning apparatus of FIG. 11.

A pair of lint screens 83*a* and 83*b* are mounted in the fourth zone 50 to enclose the respective fan openings 72*a*, 72*b*, and 71*a*, 71*b*, as well as the gas burners positioned in front of the fan openings. The lint screens 83*a* and 83*b* extend upwardly from adjacent the bottom wall 37 of the oven assembly, to the support walls 84*a*, 84*b*, which are connected to or otherwise supported by the support members 68 and 69. It will be understood that the support walls 84*a* and 84*b*, in addition to providing supportive mounting for the lint screens, also partially define an air inlet plenum for each of the sets of fans 73*a*, 73*b*, and 76*a*, 76*b*. Since the lint screens 83*a* and 83*b* must be periodically cleaned to remove lint and other particulate matter which tends to clog the screens, each of the lint screens is preferably equipped with cleaning apparatus as shown in FIGS. 11 and 12 and described hereinbelow.

The main heating region 41 is provided with an appropriate air inlet passage, such as the opening 87 in the back end 16, to admit make-up air to the oven assembly as needed. The make-up air opening 87 is preferably provided with a demand-type closure such as the pivotally-mounted door 88, which is openable to admit make-up air into the main heating region 41 in response to subatmospheric pressure within such region.

A number of carpet support rollers 90 are rotationally mounted within the oven assembly 12, immediately beneath the path along which the carpet 13 travels through the oven assembly. The carpet support rollers are power driven to provide vertical support and forward travel for the carpet (or other textile product) in a manner known to those skilled in the art.

It is seen in FIG. 2 that the valve 64 in the fuel supply line 62 to the superheat burners 63a and 63b is opened to operate the superheat burner in response to a signal condition received from the coincidence gate 93. The coincidence gate 93 receives a first input signal along the signal line 95 and the temperature control 96 from the temperature sensor 65, which is disposed in the superheat region 40 to measure the temperature of air which has just passed through the carpet 13 into the second zone 48. The disclosed placement of the temperature sensor 65 adjacent to the dividing wall 42 exposes the sensor to air passing through the carpet (or other textile product) at the point of maximum duration within the superheat region 40, so that the sensor measures the temperature of air which has passed through the hottest portion of the carpet. The temperature control 96 receives the temperature signal from the sensor 65 and provides a temperature signal condition to the coincidence gate 93 indicating whether or not the sensed temperature is less than a predetermined critical temperature $T_c$. The coincidence gate 93 also receives a signal condition on the line 94 whenever the tenter mechanism is operating to convey the carpet or other textile product through the dryer. Those skilled in the art will recognize that the line 94 can receive a signal in response to the application of electrical power to the tenter drive motor, for example, or that the line 94 can alternatively receive a signal from a suitable tenter motion-responsive mechanism such as a tachometer connected to measure tenter mechanism movement. It is intended that the coincidence gate 93 provides a signal to the superheat burner valve 64, allowing the superheat burner 63*a* to heat the atmosphere in the superheat region, only when the tenter frame mechanism is operating concurrently with the temperature of the air passing through the carpet in the superheat region 40, as measured by the temperature sensor 65, being less than a certan critical temperature $T_c$.

The carpet is supported for movement through the dryer by a tenter frame assembly shown in partial detail in FIGS. 7–9, and including the pair of endless chains 21 and 22 which move through chain passages in respective chain support members 111*b* and 111*a*, and which are power-driven at a selectively controllable rate of speed in a manner and with a drive mechanism known to those skilled in the art. The chain 22 is typical and is seen in FIG. 9 to move along a chain passage 110 provided in a chain support member 111a which extends longitudinally along the dryer assembly. One or more support rollers 112 are mounted on corresponding brackets 113 depending downwardly from the chain support member 111*a*, and each support roller 112 rests on a lateral rail 114 for rolling movement therealong. It will be understood that the support roller 112, bracket 113, and lateral rail 114 at least partially support the weight of the tenter frame assembly. Attached to each chain at spaced-apart intervals are a number of support brackets 23 extending from the chain laterally inwardly of the dryer, and each support bracket has attached one or more pins 24 for engaging the edge of the carpet 13 passing through the dryer.

Since the superheat region 40 and the main heating region 41 are each divided into upper and lower zones that are operated at differential air pressures, as set forth below in detail, it is necessary to provide some means for preventing unwanted airflow around the lateral edges of the carpet 13 at all times, and especially when the tenter frame assembly is adjusted inwardly of maximum carpet width, thereby providing longitudinal gaps 115*a* and 115*b* (FIGS. 3, 7, and 8) extending along the outside of the chain support members 111a and 111b. Turning to FIG. 7, it is seen that a roll 117*a* of air-impermeable and heat-resistant material 118, such as asbestos sheet, is wound on a shaft 119*a*, and another roll 120*a* of said material 118 is wound on a shaft 121*a*. The shafts 117*a* and 121*a* are mutually collinear and extend longitudinally along the dryer assembly, mounted on bearing blocks which are proximately spaced above the structural support member 68 as seen in FIG. 3. The two sheets of material 118 are drawn from the lower sides of the respective rolls 117*a* and 120*a* and extend laterally inwardly of the dryer assembly for attachment to the clamp bracket 122 connected to the chain support member 111 of the tenter frame assembly.

It will be understood from FIG. 7 that the right side of the dryer assembly, as viewed in that Figure, also has tenter seal structure designated with the suffix *b* in place of the *a*-suffix numerals denoting the corresponding elements of the tenter seal structure on the left side of the dryer assembly.

A cable spool 125*a* is connected to one end of the shaft 119*a*, and a length of cable 126*a* winds around the cable spool 125*a* and extends laterally across the dryer assembly to terminate in connection with a tension spring 127*b* attached to the chain support member 111*b* associated with the right-hand portion of the tenter frame assembly. A cable spool 125*b* is connected to an end of the shaft 119*b*, and a length of cable 126*b* winds around the cable spool 125*b* and extends laterally across the dryer assembly for connction to a tension spring 127*a* supported on the left-hand tenter chain support member 111*a*. A typical eyebolt 128 connects the spring 127*a* to the chain support member 111*a*.

The shafts 121*a* and 121*b* are similarly equipped with cable spools, cables, and cable interconnections which are similar to the corresponding structure described in the immediately-preceding paragraph.

Turning to the operation of the tenter seal assembly described in FIGS. 7–9, it will be understood that the chain support members 111*a* and 111*b* are selectively movable in a lateral direction, toward or away from each other, in response to the operation of the track 29 and associated drive mechanism described above. As the chain support members 111a and 111b move toward each other, for example, sheets of the heat-resistant and impermeable material 118 are unrolled from the several material rolls and effectively obstruct the flow of air through the longitudinal gaps 115*a* and 115*b* which would otherwise permit air to bypass the desired path of flow through the carpet 13. As each chain support member 111*a* and 111*b* moves laterally in a direction toward the opposite side of the dryer assembly, movement of the cables 126*a* and 126*b* is taken up by winding on the corresponding cable spools 125*a* and 125*b*. The tension springs 127 maintain tension in the cables at all times. The unrolled positions of the roll 117*a* is shown in phanton in FIG. 8.

Assuming that the chain support members 111*a* and 111*b* are being moved laterally away from each other to accommodate a carpet of greater width than previously dried in the present dryer assembly, the outward movement of the chain support members causes the cable 126*b* to rotate the cable spool 125*b* and the shaft 119*b* in a direction to wind the material 118 on the roll 117*b*, and imparts similar winding motion to the roll 117*a* by the cable 126*a*.

The length of sheet member 118 extending longitudinally along each side of the dryer assembly is split into plural separated rolls to minimize uneven winding and other problems which could occur with repeated winding and unwinding of a single roll of material sufficiently long to seal the gap 115*a* and 115*b* along the entire length of the present dryer assembly. Turning now to the operation of a dryer according to the present inventon, it will be understood from the foregoing description that the fans 73*a*, 73 *b* and 76*b* associated with the main heating region 41 constantly operate to withdraw air from the fourth zone 50, below the carpet 13, and to return such withdrawn air to the third zone 49, above the carpet. Each of the main heating region fans thus cooperates to establish and maintain a differential pressure across the carpet 13 passing through the main heating region 41, with the pressure in the third zone 49 above the carpet being greater than the pressure in the fourth zone 50 beneath the carpet. The pressure differential maintained across the carpet passing through the main heating region 41 causes the heated air in the third zone 49 to flow through the carpet and return to the fourth zone 50 to be reheated by the main burners 82*a* and 82*b* and again recirculated by the fans associated with the main heating region, assuming that the carpet or other textile product is sufficiently porous. It will be understood that carpet products having a woven backing material generally have sufficient porosity for flow-through drying operation of the type described herein, whereas carpets having a foamed backing material are substantially nonporous and cannot be dried with the present drying apparatus.

Referring particularly to FIGS. 4, 5, and 6, it is seen that the plenums 70*a* and 70*b*, associated with the main heating region 41, are in airflow communication with the plenums 53*a* and 53*b* associated with the superheat region 40. The interconnecting plenums 70*a*, 53*a* and 70*b* 53*b* thus provide ducts in communication between the first zone 47, above the carpet passing through the superheat region 40, and the heated air recirculating in the main heating region 41. The exhaust fans 58 and 59 operate to withdraw air from the second zone 48, below the carpet passing through the superheat region 40, thereby lowering the air pressure in the second zone 48 relative to the air pressure in the first zone 47. The differential pressure maintained in the superheat region 48 by the fans 58 and 59 causes heated air to flow from the main heating region through the ducts defined by the aforementioned plenums, and into the first zone 47 where the heated air withdrawn from the main heating region receives additional heat supplied by the superheat burners 63*a* and 63*b*. The air heated in the second zone 48 of the superheat region 40 by the superheat burners is raised to a temperature greater than the air which is being recirculated in the main heating region 41.

Figure 10:
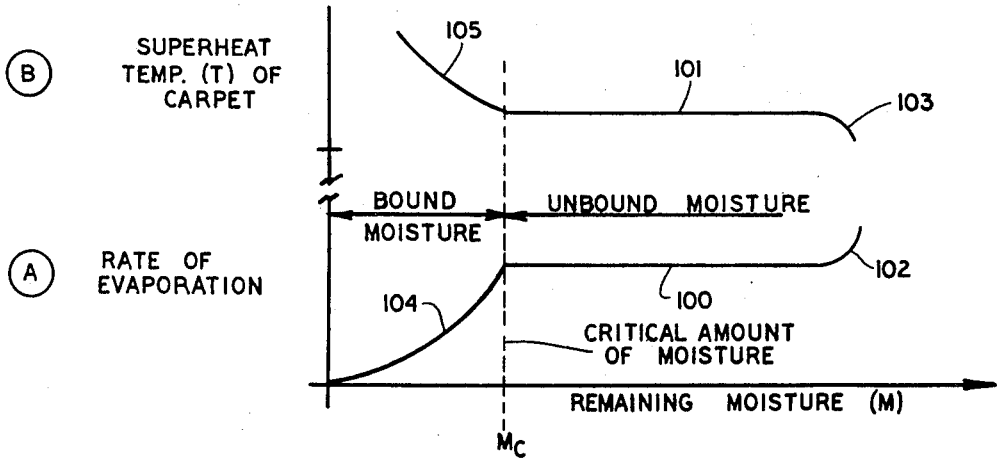
FIG. 10 is a graphical representation of the drawing process provided by the present invention.

Since the carpet 13 entering the superheat region 40 is assumed to be substantially saturated with moisture, the superheat region can be operated to subject the carpet 13 to an air temperature actually exceeding the temperature at which the carpet itself would be damaged. This operation of the superheat region is better understood with reference to FIG. 10, showing the rate of evaportion and the temperature of the carpet within the superheat region as a function of the amount of moisture remaining in the carpet. So long as a determinable critical amount ($M_c$) of moisture remains in the carpet while the carpet is exposed to superheat temperatures in excess of the damage temperature of dry carpet, virtually all of the heat transferred to the wet carpet is used to evaporate the moisture carried by the carpet and substantially none of the transferred heat remains to raise the temperature of the carpet. The rate of evaporation of moisture is substantially constant at this time, as shown at 100 on FIG. 10(A), indicating that the unbound moisture in excess of the aforementioned critical amount of moisture is being evaporated from the wet carpet. Referring to FIG. 10(B), it is seen at 101 that the temperature of the carpet remains substantially unchanged while the unbound moisture is being evaporated, reflecting the fact that substantially all of the heat transferred to the carpet is being expended to evaporate the unbound moisture. A slight amount of temperature rise in the carpet may be detected during evaporation of unbound moisture, in actual practice, but such temperature rise occurs at a relatively low rate and does not approach the damage temperature of the carpet. The declining rate of evaporation 102, and the corresponding initial increase 103 in carpet temperature, represent transient conditions occurring immediately after the moisture-laden carpet enters the superheat zone and while the rate of evaporation and carpet temperature are becoming stabilized.

As the amount of moisture remaining in the carpet is reduced to the critical amount $M_c$, corresponding to the absence of any remaining unbound moisture, it is seen at 104 in FIG. 10(A) that the rate of moisture evaporation commences to decline exponentially toward zero remaining moisture, i.e., dry carpet. Referring to FIG. 10(B), it is also seen at 105 that the temperature of the carpet concurrently undergoes a relatively rapid increase, reflecting the fact that the moisture remaining in the carpet for evaporation is insufficient to use all of the heat being transferred to the carpet. The temperature of the carpet during the period of increasing temperature 105 will rapidly exceed the carpet damage temperature, unless the carpet is first withdrawn from the superheat region or unless the superheat burners 63*a* and 63*b* are turned off.

The rate at which the carpet or other textile product is moved through the superheat region 40 is selected so that the carpet remains in the superheat region no longer than the amount of time necessary to evaporate substantially all of the unbound moisture contained therein. Operation in the superheat zone thus is maintained in the range of substantially constant rate of evaporation 100 and substantially constant carpet temperature 101, depicted in FIG. 10. The actual rate at which a carpet or other textile product traverses the oven assembly 12 obviously depends on a number of variable factors, such as the temperature of the air within the superheat region, the amount of moisture carried by the textile product, the porosity and the damage temperature of the textile product, and the length of the path traversed by the textile product through the superheat region. The air temperature within the main heating region 41 is maintained at a temperature below the damage temperature of the textile product being dried, and the remaining or bound moisture in the textile product is evaporated during the passage of the textile product through the main heating region.

Since moisture is evaporated from carpet in the superheat region at a rate greater than the rate of evaporation in the main heating region, it is apparent that the unbound moisture in the carpet can be substantially or entirely removed in a dryer having only a fraction of its overall length devoted to the superheat region. An actual carpet dryer designed according to the present invention has an overall oven assembly length (superheat region plus main heating region) of approximately 48.76 meters, and has a superheat region length of approximately 0.54 meters; the foregoing figures are by way of example only, however, and are not intended to define limitations of the present invention. The aforementioned specific example of drying apparatus is designed to dry tufted carpet product having a woven backing made of jute, and having adequate porosity to permit flow-through drying according to the present invention while airflow in the range of 400–500 feet/minute is maintained through a 12 feet wide web of the carpet with a differential pressure across the web of not more than about 8 inches of water.

Since the superheat region 40 is intended to operate at a temperature greater than the damage temperature of the material being dried, it is useful to monitor the superheat drying operation to ensure that moisture removal within the superheat region is restricted to unbound moisture as illustrated at 100, 101 in FIG. 10. Such monitoring is accomplished, in the disclosed embodiment, through the temperature sensor 65 positioned to monitor the temperature of air passing through the carpet immediately before the carpet exits the superheat region. If the measured air temperature exceeds a preset temperature on the slope 105 of FIG. 10(B), indicating that substantially all of the unbound moisture has been evaporated, a signal condition is provided by the temperature control 96 to the coincidence gate 93 to close the superheat burner valve 64 so that the superheat burner is turned off. The superheat burner is also immediately turned off in response to a signal condition on line 94 indicating that the tenter mechanism is inoperative, since the temperature of the carpet in the superheat zone would otherwise rapidly rise to a temperature which could damage the carpet. Since the air in the main heating region 41 is normally maintained at a temperature less than the carpet damage temperature, it is not necessary to provide similar safeguards for the operation of the burners associated with the main heating region.

Air is exhausted to atmosphere from the superheat region 40 only, and make-up air is supplied only to the main heating region 41. The superheat region receives already-heated air from the main heating region, thereby reducing the amount of fuel required to achieve superheat temperatures and eliminating wastage of the heat in the air withdrawn from the main heating region 41. By way of example and without intent to limit, a dryer according to the present apparatus and intended for drying tufted carpet product can operate with the burners in the main heating region providing heated air in the range of 280°–300° F., and with the burners in the superheat region providing superheat air in the range of 400°–450° F. Those skilled in the art will recognize that other temperature ranges may be more appropriate for drying other types of textile products. The temperature control 96 in the aforementioned example of carpet dryer is operative to close the superheat burner valve 64 if the sensed temperature of the air which has flowed through the carpet in the superheat region exceeds approximately 200° F. As an alternative to measuring the carpet temperature just before the carpet exits the superheat region, the temperature sensor 65 could be repositioned to measure the temperature of heated air withdrawn from the superheat region by the fans 58 and 59. The measured temperature of the exhausted air provides an indication of average operating conditions within the superheat region, however, and the location of the temperature sensor depicted in FIG. 2 may be preferable, in many applications, as measuring air temperature which is more nearly indicative of the maximum temperature which the carpet attains within the superheat region.

Although the disclosed embodiment uses gas-fired burners to provide heat in both the main and superheat regions, it will be apparent to those skilled in the art that other heat sources can alternatively be used to impart the requisite amount of heat to the main and the superheat regions. For example, steam coils can be separately provided in the main heating region and in the superheat region, positioned in heat transfer relation to the air being directed onto the carpet in each region. A greater number of steam coils would be required in the superheat region, relative to the number of steam coils in the main heating region, to provide the necessary superheating of air in the superheat region. The output signal condition from the coincidence gate 93 would be connected to a steam supply valve associated with the superheat steam coils, so that steam is removed from all or at least some of the superheat coils if it becomes necessary to shut down the superheat region.

The exhaust fans 58 and 59 can be operated to provide a pressure differential across the carpet in the superheat region that is substantially the same as the pressure differential maintained across the carpet in the main heating region. It will be understood, in such case, that the velocity of air flowing through the carpet in the superheat region is lower than the flow-through velocity in the main heating region, since the effective porosity of the moisture-laden carpet in the superheat region is less than the effective porosity of the relatively dryer carpet passing through the main heating region.

A disclosed embodiment of apparatus for automatically claiming the lint screens 83*a* and 83*b* is shown in FIG. 11 as applied to the lint screen 83*a*, and it will be understood that similar apparatus is provided for claiming the other lint screen 83*b*. A pair of track members 131 and 131′ extend along the upper and lower sides, respectively, of the longitudinally-extending lint screen 83*a*. A carriage assembly 132 is carried by the traversing apparatus 138 for traversing movement along the track members 131 and 131′. Traversing motion is imparted to the carriage assembly 132 through traversing means including the traverse motor 133 connected to rotate a pulley 134, around which is wound an endless cable 137. The cable 137 extends longitudinally along the upper end of the track assembly 131 to be wound around the pulley 136 mounted on the shaft 138 which is rotatably supported by the bracket 135. A bracket 143 connects the traversing apparatus to the cable 137. The lower end of the carriage assembly 132 traverses the lower track member 131′ with either sliding or rolling engagement as appropriate.

Defined within the carriage assembly 132 is an elongate aperture or slot 146 which contacts the surface of the lint screen 83*a* along one side thereof, and which is coextensive with the vertical width of the lint screen. The cover 147 of the carriage assembly 132 defines a plenum in communication with the slot 146, and the cover is connected in flow communication with a filter housing 148 within which is received the filter bag 150. An exhaust blower 149 is attached for traversing movement with the carriage assembly 132 and is connected to withdraw air from the plenum and through the filter bag 150, so that lint and other paticulate matter lodged on the lint screen 83*a* is vacuumed through the slot 146 and is retained in the filter bag 148.

Although the lint screen cleaning apparatus shown in FIG. 11 can be manually actuated to vacuum the screen 83*a* while traversing the length of the screen, automatic operation of the screen cleaning apparatus is advantageously provided with the control circuit shown in FIG. 12. Since lint and other matter lodged in the screen 83*a* reduce airflow through the screen, a differential pressure sensor 152 is connected to sense the pressure drop occurring across the screen and operates to close the switch contact 152*a* when the measured differential pressure exceeds a predetermined differential pressure. Closure of the switch 152*a*, as seen in FIG. 12, applies electrical power along the line 153 to operate the blower 149 and the traverse motor 133, whereupon the carriage assembly 132 is pulled by the moving cable 137 to traverse the vacuum slot 146 along the length of the screen.

Electrical power is also supplied to the relay coil 154 to close the normally-open relay contact 154*a*, completing a circuit through the two normally-closed limit switches 155 and 156. The relay contact 154a and the two limit switches 155, 156 provide a series circuit path which is in parallel with the switch contact 152a, so that the relay coil 154 will now remain energized even if the switch contact 152a subsequently opens.

Referring to FIG. 11, it is seen that the limit switches 155 and 156 are positioned at opposite ends of the track member 131 for actuation by the traversing apparatus 138 when the carriage assembly 132 has traversed to one or the other of the screen ends, in response to which the switch contact of the respective limit switch become open-circuit.

As the screen 83*a* is progressively cleaned of lint and other matter by traverse of the carriage assembly 132, it will be understood that the differential pressure across the screen is again lowered to a pressure which allows the switch contact 152*a* to become opened. This opening of the switch contact 152*a* may occur before the carriage assembly 132 has completed one complete traverse of the screen, but the parallel circuit provided by the relay contacts 154*a* and the limit switches 155, 156, maintains power to the blower 149 and the traverse motor 132, as well as to the relay coil holding circuit including the line 153. As soon as the traversing apparatus 138 contacts one of the limit switches at an end of travel, however, power is removed from the blower and the traverse motor and also from the aforementioned holding circuit, whereupon the relay contact 154*a* is opened and the screen cleaning cycle is terminated. The traverse motor 33 may be of the type which is self-reversing, for operation in the reverse direction for the next cleaning cycle in response to subsequent operation of the differential pressure sensor 152. Those skilled in the art will recognize, alternatively, that the traverse motor 33 can be unidirectional and that the traversing apparatus 138 can alternatively traverse the screen in opposite directions through go-around travel of the bracket 143 about the respective pulleys 134 and 136.

It will be understood that the foregoing relates only to a disclosed embodiment of the present invention, and that numerous alterations and modifications may be made therein without departing from the spirit and the scope of the invention as set forth in the following claims.

What is claimed is:

1. Dryer apparatus for drying a porous textile product and the like, comprising:

a substantially enclosed housing having a front wall and a back wall;

a product entry opening defined in said front wall and a product exit opening defined in said back wall;

means defining a predetermined path for the movement of product within said housing from said inlet opening to said exit opening;

first means positioned in said housing above said path and dividing the portion of the housing above the path into an upper exit zone adjacent said back wall and an upper entry zone adjacent said front wall;

second means positioned in said housing below said path and dividing the portion of the housing below the path into a lower exit zone adjacent said back wall and a lower entry zone adjacent said front wall;

air recirculation means in air flow communication with said lower and upper exit zones for maintaining recirculating air flow in a first air flow path including withdrawing air from said lower exit zone and supplying said withdrawn air to said upper exit zone for passage through a product in said predetermined path and return to the lower exit zone;

first heating means positioned in said first air flow path for heating the recirculating air in the first air flow path;

air passage means operative to withdraw a portion of said recirculating heated air and connected to supply said withdrawn air to said upper entry zone;

second heating means positioned to heat said withdrawn portion of air supplied by said air passage means to said upper entry zone;

air exhaust means in air flow communication with said lower entry zone for drawing said heated air from said upper entry zone through a product in said predetermined path, into the lower entry zone, and out of said housing;

sensing means responsive to the magnitude of a variable parameter which is affected by the temperature attained by said product while passing along said lower and upper entry zones to provide an output indicative of the temperature of such product; and control means controlling the operation of said additional heating means and operative in response to the output of said sensing means to terminate operation of said second heating means when said variable parameter becomes a predetermined magnitude.

2. Dryer apparatus for carpet and the like, comprisg:

a substantially enclosed housing including a front wall and a back wall;

a carpet entry opening defined in said front wall;

a carpet exit opening defined in said back wall;

conveying means for moving carpet along a predetermined path within said housing from said entry opening to said exit opening;

first partition means positioned in said housing above said predetermined path and dividing the portion of the housing above said path into an upper exit zone adjacent said back wall and an upper entry zone adjacent said front wall;

second partition means positioned in said housing below said predetermined path and dividing the portion of the housing below said path into a lower exit zone adjacent said back wall and a lower entry zone adjacent said front wall;

heating means in said lower exit zone for heating the air in said lower exit zone;

air recirculation means in air flow communication with said lower and upper exit zones for withdrawing air from said lower exit zone and supplying a first portion of said withdrawn air to said upper exit zone to flow through a carpet in said path and return to said lower exit zone;

additional heating means connected to receive a second portion of said withdrawn air and to supply additional heat to said second portion of withdrawn air;

duct means in air flow communication with said additional heating means and said upper entry zone for supplying said additionally heated air from the additional heating means to the upper entry zone;

air exhaust means in air flow communication with said lower entry zone for drawing air from said upper entry zone through a carpet in said path, into the lower entry zone, and out of the lower entry zone and out of said housing;

sensing means positioned for exposure to the air drawn through the carpet into said lower entry zone and providing an output signal condition responsive to the temperature of said air; and control means controlling the operation of said additional heating means and operative in response to the output signal condition of said sensing means to terminate operation of the additional heating means when said output signal condition corresponds to the measured temperature of said withdrawn air being greater than a predetermined temperature.

* * * * *